US005335600A

United States Patent [19]

Hörr et al.

[11] Patent Number: 5,335,600

[45] Date of Patent: Aug. 9, 1994

[54] PROPELLANT CHARGE IGNITER

[75] Inventors: Alfred Hörr, Zirndorf; Heinz Reiss; Uwe Brede, both of Fürth, all of Fed. Rep. of Germany

[73] Assignee: Dynamit Nobel AG, Troisdorf, Fed. Rep. of Germany

[21] Appl. No.: 159,572

[22] Filed: Dec. 1, 1993

[30] Foreign Application Priority Data

Dec. 1, 1992 [DE] Fed. Rep. of Germany ..... 4240273

[51] Int. Cl.[5] ..... F42C 19/08; F42B 5/26

[52] U.S. Cl. ..... 102/470; 102/202; 102/430; 102/431; 102/472

[58] Field of Search ..... 102/202, 204, 202.5, 102/380, 430–433, 469, 470, 472, 700

[56] References Cited

U.S. PATENT DOCUMENTS 4,492,167 1/1985 Brede et al. ..... 102/470
4,674,405 6/1987 Brede et al. ..... 102/202
4,763,577 8/1988 Romer et al. ..... 102/430
4,770,099 9/1988 Brede et al. ..... 102/472
4,913,052 4/1990 Hoerr et al. ..... 102/202
5,052,302 10/1991 Taddeo et al. ..... 102/204

FOREIGN PATENT DOCUMENTS 428074 5/1991 European Pat. Off. ..... 102/430
3829657 3/1990 Fed. Rep. of Germany .

*Primary Examiner*—Harold J. Tudor
*Attorney, Agent, or Firm*—Antonelli, Terry, Stout & Kraus

[57] ABSTRACT

The invention relates to a propellant charge igniter mountable in a propellant charge carrier or in a cartridge. Propellant charge igniter is provided with an expulsion charge to avoid breech flash, said charge being suitable for driving an ignition guide tube completely out of an annular chamber formed between a bottom part and a flame guide tube of the propellant charge igniter.

9 Claims, 3 Drawing Sheets

PROPELLANT CHARGE IGNITER

BACKGROUND OF THE INVENTION

This invention relates to a propellant charge igniter for insertion into a propellant charge carrier, e.g., a cartridge, said igniter having a flame guide tube leading from an ignition charge to a lead fuze, an ignition guide tube surrounding the lead fuze and means for completely expelling the ignition guide tube from the charge igniter to avoid undesirable glowing residue which can escape from the barrel of a weapon when the bottom of the cartridge is removed.

In order to be able to fire a projectile with a propellant charge as far as possible from a firing tube, it is necessary to ignite, in a controlled fashion, the propellant charge located in a propellant charge carrier, for example a cartridge. An effort is made in this regard to ignite the entire propellant charge in such fashion that a high initial pressure is rapidly produced and the pressure is then kept at a high level for as long as possible. Pressure peaks occurring locally within the propellant charge are undesirable in this context, since such peaks negatively affect the subsequent burning of the propellant charge and also have a negative effect on the lifetime of the firing tube. Propellant charges are therefore not only ignited at one end, but special propellant charge igniters with ignition guide tubes are used.

A propellant charge igniter is known from DE 38 29 657 Al in which a lead fuse located in an elongated ignition guide tube (wound tube) is ignited by means of an igniting charge. The ignition guide tube, located concentrically with respect to a flame guide tube, has its end at a bottom-part side projecting into a bottom part. A separating charge is located within the outline of the bottom part of the flame guide tube. The propellant charge igniter also has a metal jacket located between the separating charge and the ignition guide tube. An annular seal is located in a circumferential recess in the flame guide tube at the end of the metal jacket facing away from one bottom end of the bottom part, the seal acting as a valve with the metal jacket and the flame guide tube and, in the open position, permitting the hot combustion gases of the separating charge to flow toward the ignition guide tube.

Ignition of a propellant charge with the propellant charge igniter according to DE 38 29 657 Al takes place in such fashion that the ignition charge initially ignites the lead fuse composed of annular ignition-material tablets. Then the lead fuse ignites the propellant charge through openings in the ignition guide tube, the propellant charge, in turn, then igniting the separating charge through priming holes in the bottom part. The hot gases from the separating charge force the annular seal aside and separate the ignition guide tube in the area of the end of the bottom part facing away from the bottom side. The separated part of the ignition guide tube is then hurled out of the firing tube by the gases flowing out of the firing tube, while the other part of the ignition guide tube remains connected to the bottom part.

This arrangement has the disadvantage that an undesirable glowing residue can still escape from the barrel of the weapon when the cartridge bottom is pulled out or removed.

SUMMARY OF THE INVENTION

An object of the invention is to provide a propellant charge igniter in which the danger of afterglow is avoided.

The solution to this problem is provided in accordance with the propellant charge igniter of the present invention wherein means are provided for effecting complete expulsion of the ignition guide tube from an annular chamber provided between a base of the igniter and the flame guide tube.

In the propellant charge igniter according to the invention, a powder train comprises an expeller charge for completely expelling the ignition guide tube out of the annular chamber, which commensurates with a combustion chamber at an end facing toward the bottom end of the igniter. Through the transition of the annular chamber to the combustion chamber, the gases generated in the combustion chamber by the combustion of the expeller charge can press against an end of the ignition guide tube facing the bottom end and expel it from the annular chamber. As a result, after firing, only metal parts remain on the bottom part or base of the igniter and the bottom part itself remains in the barrel of the weapon, which cool rapidly because of the good heat conduction of the metal parts. As a result of the complete expulsion of the ignition guide tube, afterglow of material in the bottom part or base of the igniter is avoided.

Since the combustion chamber and the annular chamber are located one behind the other in the lengthwise direction, it is not necessary to provide a metal jacket separating the two chambers and to provide a valve arrangement between the chambers. The annular chamber is preferably delimited by a conical inner surface of the bottom part which essentially tapers toward the bottom end or face of the igniter. This conical inner surface cooperates with a conical outer surface of the ignition guide tube, whose angle of inclination to the lengthwise axis of the propellant charge igniter corresponds to the taper angle of an inner surface of the bottom part in the annular chamber area, in such a way that a secure connection of the ignition guide tube with the bottom part before firing is guaranteed. The conical surfaces transmit impact or pressure forces on the tip of the propellant charge tube safely to the bottom part. As a result, insertion of the propellant charge igniter into a jacket filled with a propellant charge is also facilitated. The two conical surfaces also permit, however, an especially reliable separation of the ignition guide tube from the bottom part, since when the ignition guide tube is expelled, frictional forces between the ignition guide tube and the bottom part are effective only over a short area.

Preferably the bottom part, at its end facing away from the bottom side, has a toothed area on the inside meshing with the ignition guide tube. As a result of these teeth, the bottom part hooks into the ignition guide tube in such fashion that a reliable connection is provided during the transport of the propellant charge igniter. For a secure connection between the bottom part and the ignition guide tube, the bottom part can also be pressed inward at its end away from the bottom side, squeezing the ignition guide tube. This squeezing, which takes place after the ignition guide tube and the bottom part have been fitted together, creates in the ignition guide tube, the zone which abuts the end of the bottom part. The hooking and the zone formed by the squeezing create a situation such that the ignition guide tube cannot be slid further into the bottom part or be pulled out as a result of axial upsetting or by a defined axial tensile stress. As a result, the frictional force provided during the manufacture of the propellant charge igniter and adjusted to the strength of the expeller charge remains intact so that ammunition provided with the propellant charge igniter according to the invention can even be dropped by parachute. In addition, the inner surface of the bottom part can be glued to the outer surface of the ignition guide tube. One or more of the above measures for connecting the ignition guide tube with the bottom part ensures that the propellant charge igniter will display the required strength in drop tests.

In order to prevent ignition of the expeller charge by the combustion gases of the lead fuse, an immovable annular seal is located in an annular groove in the flame guide tube, said seal being in the annular groove and abutting the ignition tube and sealing the flame guide tube from the ignition guide tube surrounding it.

The expellable ignition guide tube of the propellant charge igniter, which is preferably a wound tube made of a fiber material with a plastic matrix, can be made of a combustible, consumable material which therefore largely burns up during ignition and burning of the propellant charge of the cartridge.

If especially resistant jacketing of the lead fuse is desired, the ignition guide tube can be wound from a glass-fiber-reinforced plastic.

BRIEF DESCRIPTION OF THE DRAWINGS

Additional advantageous embodiments and improvements on the invention will be apparent from the following detailed description with reference to the accompanying drawings wherein.

DETAILED DESCRIPTION OF THE INVENTION

Figure 1:
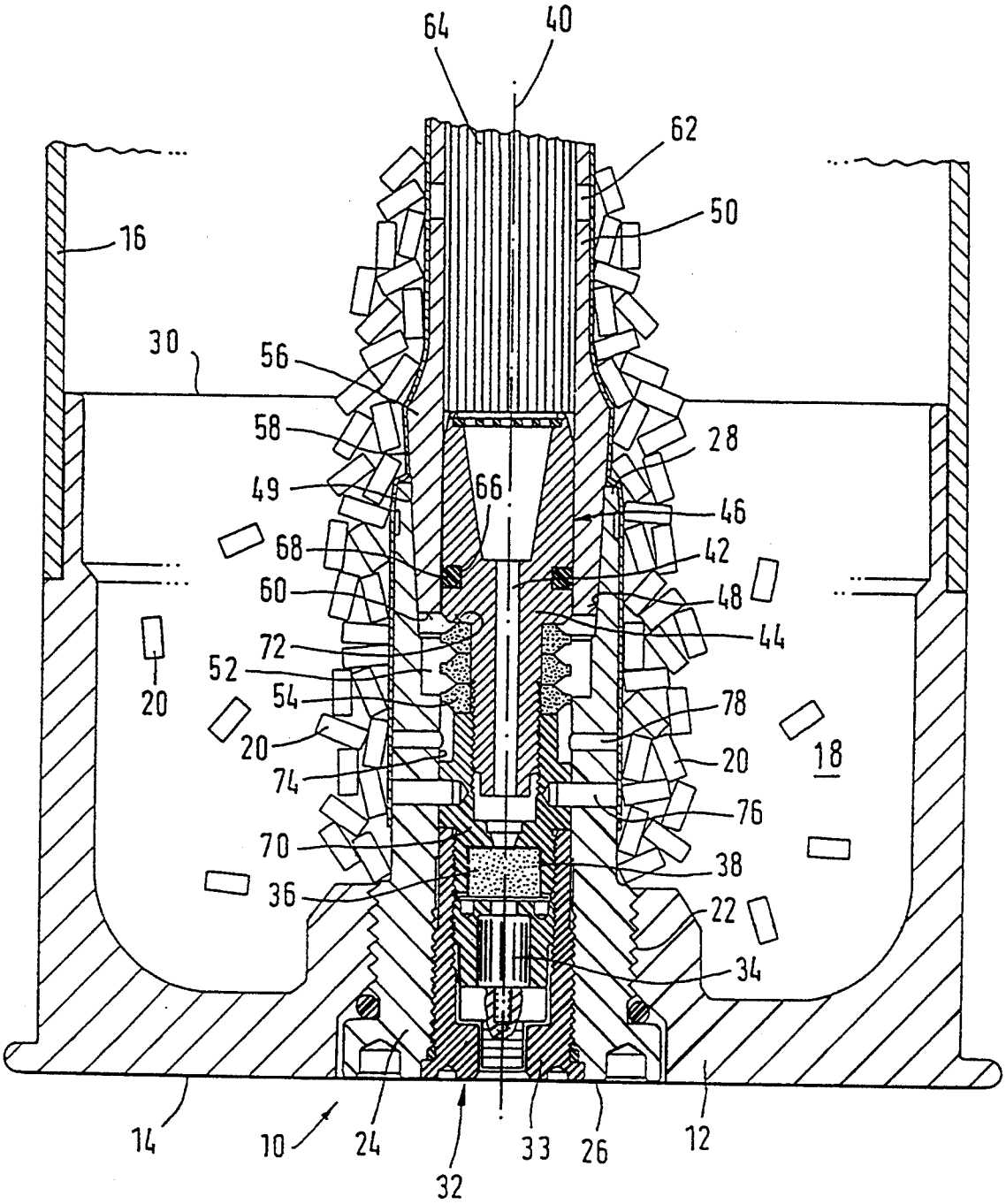
FIG. 1 is a longitudinal section through the bottom-end and of a propellant charge igniter, built into a bottom part of a cartridge.

FIG. 1 shows a propellant charge igniter 10 assembled into a cartridge bottom part or base 12 which has a cylindrical shape turned from metal. Cartridge bottom part 12 is open at its upper end away from the bottom end 14. A combustible cartridge jacket 16 abuts the upper end of cartridge bottom part 12 facing away from bottom end 14, said jacket containing at its forward end a projectile (not shown). Cartridge bottom part 12 and cartridge jacket 16 are filled with a propellant charge 18 composed of individual pourable propellant charge grains or particles 20, thus together forming a propellant charge carrier.

A centrally disposed opening 22 with a thread is provided in the cartridge base 12, into which the opening the propellant charge igniter 10 is threaded. Propellant charge igniter 10 has a bottom part or base 24 with a bottom end or surface 26 which extends coaxially with respect to the cartridge bottom part 12 and another end facing away from the bottom end 26 which other end does not project beyond an edge 30 of the cartridge bottom part 12 facing away from the bottom end 14. A fuse 32 with a cylindrical fuse housing 33 is screwed into bottom part 24, said fuse having an electrically ignitable primary ignition element 34 and a triggering charge 36 ignitable thereby. Ignition charge 36 is provided in a hollow chamber 38 in the bottom part 24, which is open in a direction away from the bottom face 26 and makes a transition there to a flame channel 42 extending along a lengthwise axis 40 of propellant charge igniter 10, said channel formed by a flame guide tube 44 made of metal. Flame guide tube 44 is permanently attached to the bottom part 24.

An outer surface 46 of the end area of flame guide tube 44 facing away from bottom face 26 and an inner surface 48 of bottom part 24 located opposite this area delimit an annular chamber 49 into which an ignition guide tube in the form of a wound tube 50 projects. An end of the annular chamber 49 facing toward the bottom face 26 is abutted by a combustion chamber 52 in which an expeller charge 54 is located. Expeller charge 54 consists of annular propellant tablets surrounding a tapered area of the flame guide tube 44. Wound tube 50 consists of fiber-reinforced plastic, especially of plastic reinforced with high strength textile fibers consumable by combustion, and has at its end facing bottom face 26 a thickened portion 56, whose outer surface 58 tapers towards the bottom face 26. The slope angle of the outer surface 58 relative to the lengthwise axis 40 of the propellant charge igniter corresponds to that of the inner surface of the bottom part 24 in the vicinity of the annular chamber 49. Wound tube 50 has an annular end face 60 facing combustion chamber 52. A lead fuse 64 is located in the wound tube 50 which has radially extending openings 62. Wound tube 50 surrounding a portion of the flame guide tube 44, which is essentially circularly cylindrical in the vicinity of annular chamber 49, is sealed off from the flame guide tube 44 by means of an annular seal 68 located in an outer annular groove 66 of the flame guide tube 44. Annular groove 66 and annular seal 68 are designed such that the annular seal 68 is immovable in the annular groove 66.

In order to facilitate assembly of the propellant charge igniter 10, bottom part 24 has a metal intermediate part or element 70 into which flame guide tube 44 is screwable in such fashion that the expeller charge 54 is held around the flame guide tube 44 between a shoulder 72 and the intermediate part 70. Intermediate part 70 is located in a concentric lengthwise bore 74 of the bottom part 24 and is held by pins 76 which project through the bottom part 24 into the intermediate piece 70. The essentially hollow cylindrical bottom part 24 also has radially extending priming openings 78, through which combustion chamber 52 communicates with the inner chamber of the cartridge, filled by propellant charge 18 and surrounding bottom part 24.

Figure 2:
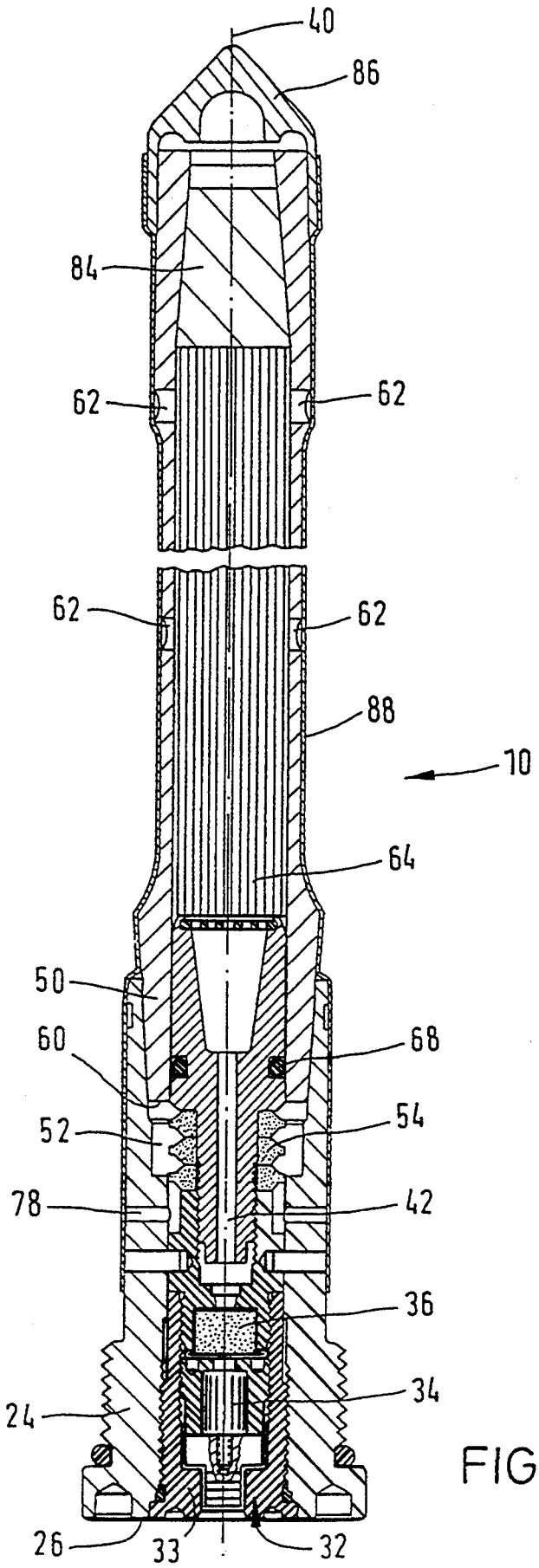
FIG. 2 shows the entire propellant charge igniter shown partially in FIG. 1 in longitudinal section.
Figure 3:
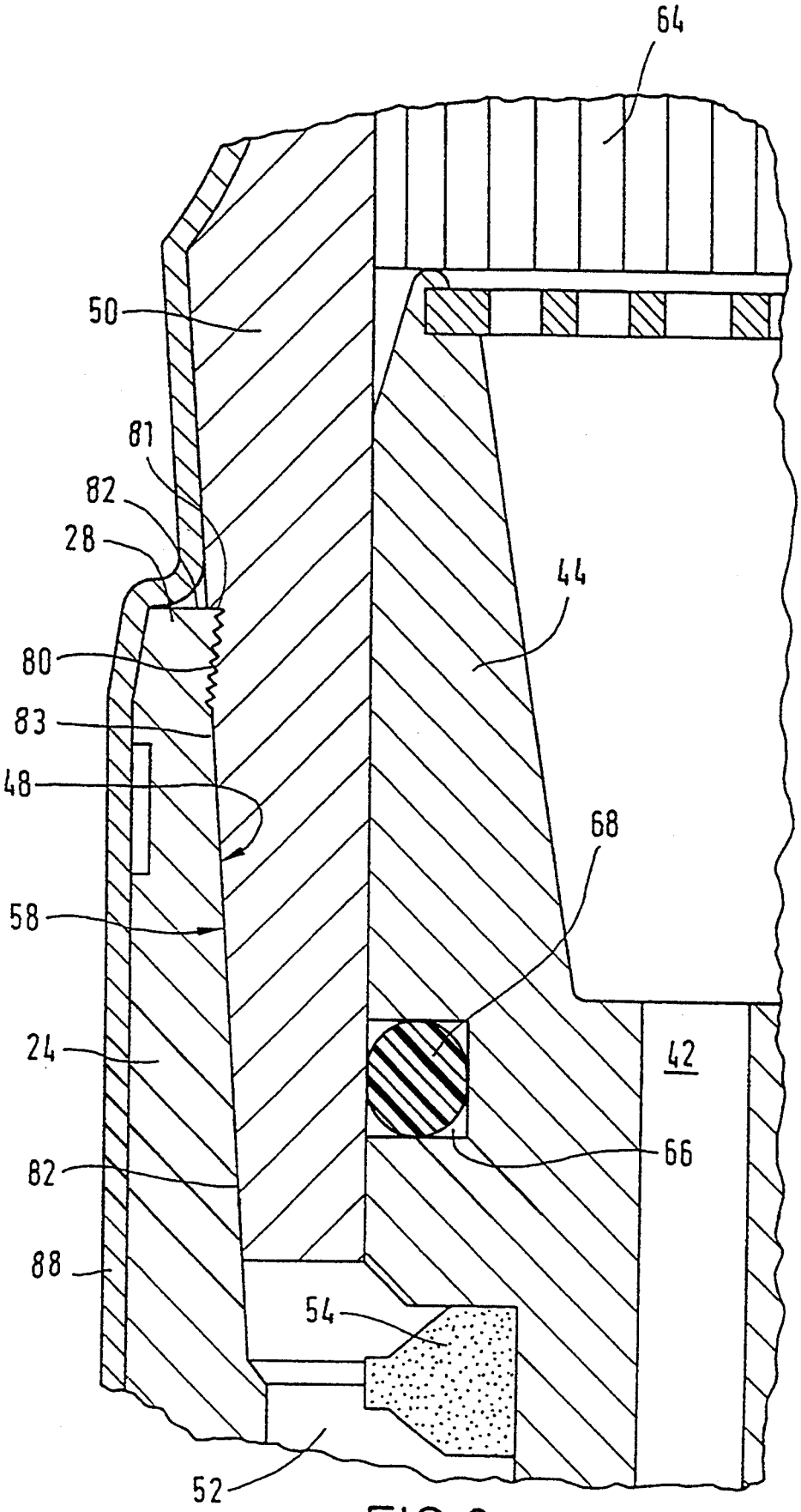
FIG. 3 shows an enlarged partial sectional view of the bottom end of an ignition guide tube built into a bottom piece.

In order to make the connection between wound tube 50 and bottom part 24 as resistant to impact as possible, bottom part 24, at its end 28 facing away from the bottom face 26, has teeth 80, preferably a shallow thread as shown in FIG. 3. The teeth engage wound tube 50. Bottom part 24 is also crimped or compressed radially inward at its end 28 facing away from the bottom face 26 and surrounding the wound tube 50. Compression forms a crimped zone 81 in the wound tube 50 which abuts upper end 82 of the bottom part 24. Between the conical outer surface 58 of the wound tube 50 and the conical inner surface 48 of bottom part 24, a layer of adhesive 83 can also be provided. In order to seal off the wound tube 50 at the end 28 facing away from the bottom face 26, a plug 84 is provided as shown in FIG. 2. In addition, the wound tube 50, at its forward end 28 facing away from the bottom face, is provided with a tip 86 which facilitates insertion of propellant charge igniter 10 into poured propellant charge 18. In addition, fitting of the propellant charge igniter 10 is facilitated by a thin covering 88 made of thermoplastic plastic, preferably a shrink tube, which extends over the entire wound tube 50 and over the area of bottom part 24 containing the priming openings 78, and protects the propellant charge igniter 10 against the penetration of moisture.

The electrically actuatable ignition-triggering element 34 is triggered to ignite propellant charge 18. Element 34 ignites ignition charge 36 whose hot gases then pass through flame channel 42 to lead fuse 64. The hot compressed gases from lead fuse 64 break the covering 88 over openings 62 and ignite propellant charge 18. The propellant charge gases then accelerate the projectile and, breaking through the covering 88 arranged over priming openings 78, pass through the openings into combustion chamber 52. Expulsion charge 54 located in combustion chamber 52 then ignites, and its gases act on the annular end 60 of wound tube 50, which then breaks loose from its frictional connection with bottom part 24. The thickness of expulsion charge 54 is selected so that the force generated by the compressed gases overcomes the force of friction, the force in adhesive layer 83, and the force of teeth 80. Wound tube 50, after coming loose from its connection with bottom part 24, is expelled by the suction effect of the propellant charge gases out of the impact bottom area of the weapon in order to burn better in the erosive gas stream. Undesirable early ignition of expulsion charge 54 is prevented by annular seal 68 in propellant charge igniter 10.

What is claimed is:

1. A propellant charge igniter which comprises a bottom part adapted to be positioned within a propellant charge carrier, said bottom part having a hollow chamber for receiving an ignition charge; a flame guide tube having a flame channel extending essentially from the ignition charge to a lead fuse; and an ignition guide tube provided with openings and surrounding the lead fuse, an end portion of said ignition guide tube being fitted in an annular chamber formed between the bottom part and the flame guide tube and surrounding the flame guide tube in a sealing fashion; said annular chamber being open toward an end of the bottom part facing away from a bottom end of the bottom part, and a powder train located in an annular combustion chamber surrounding the flame guide tube and adapted to be ignited by a propellant charge located in the propellant charge carrier via priming openings extending radially through the bottom part; the annular chamber providing a transition zone leading to the combustion chamber at an end facing the bottom end and the powder train comprising an expulsion charge for effecting complete expulsion of the ignition guide tube out of the annular chamber.

2. A propellant charge igniter according to claim 1, wherein the annular chamber is delimited by a conical inner surface of the bottom part that tapers mainly toward the bottom end and the ignition guide tube has a conical outer surface whose angle of inclination to lengthwise axis of the propellant charge igniter corresponds to a taper angle of the inner surface of the bottom part in an area around the annular chamber.

3. A propellant charge igniter according to claim 1, wherein the bottom part has at its end facing away from the bottom end, on its inner side, teeth or projections meshing with the ignition guide tube.

4. A propellant charge igniter according to claim 1, wherein the bottom part at its end facing away from the bottom end is squeezed inward, crushing a portion of the ignition guide tube, thereby forming a step within the ignition guide tube.

5. A propellant charge igniter according to claim 1, wherein an inner surface of the bottom part is glued to an outer surface of the ignition guide tube.

6. A propellant charge igniter according to claim 1, wherein an annular seal is provided between the ignition guide tube and the flame guide tube.

7. A propellant charge igniter according to claim 1, wherein the ignition guide tube is made from combustible material.

8. A propellant charge igniter according to claim 7, wherein the ignition guide tube comprises a tube wound from a fiber-reinforced plastic.

9. A propellant charge igniter according to claim 1, wherein the ignition guide tube comprises a tube wound from a fiber-reinforced material.

* * * * *